US006435427B1

(12) United States Patent
Conroy

(10) Patent No.: US 6,435,427 B1
(45) Date of Patent: Aug. 20, 2002

(54) NOZZLE ASSEMBLY WITH AN EXTENDABLE TURRET

(75) Inventor: John Conroy, Marshville, NC (US)

(73) Assignee: Coltec Industries, Inc., Charlotte, NC (US)

( * ) Notice: Subject to any disclaimer, the term of this patent is extended or adjusted under 35 U.S.C. 154(b) by 24 days.

(21) Appl. No.: 09/761,273

(22) Filed: Jan. 16, 2001

(51) Int. Cl.[7] ..... A62C 31/02

(52) U.S. Cl. ..... 239/392; 239/394; 239/456; 239/440; 285/38

(58) Field of Search ..... 239/390–395, 239/397, 437, 438, 440–442, 447, 451, 456, 583, 569, 580, 460; 285/38

(56) References Cited

U.S. PATENT DOCUMENTS

| | | | | |
|---|---|---|---|---|
| 2,027,567 A | | 1/1936 | Webb | |
| 2,388,093 A | * | 10/1945 | Smith | 239/394 |
| 2,711,925 A | | 6/1955 | King | |
| 2,790,680 A | | 4/1957 | Rosholt | |
| 3,065,917 A | * | 11/1962 | Fraser | 239/460 |
| 3,081,950 A | | 3/1963 | Rinkewich | |
| 3,516,611 A | | 6/1970 | Piggott | |
| 3,547,352 A | * | 12/1970 | Hadsel | 239/460 |
| 3,558,061 A | | 1/1971 | Hansen | |
| 3,596,835 A | | 8/1971 | Smith et al. | |
| 3,704,831 A | | 12/1972 | Clark | |
| 3,779,533 A | * | 12/1973 | Etter | 239/441 |
| 3,814,326 A | | 6/1974 | Bartlett | |
| 3,982,698 A | | 9/1976 | Anderson | |
| 4,094,468 A | | 6/1978 | Volle | |
| 4,117,979 A | * | 10/1978 | Lagarelli et al. | 239/394 |
| 4,141,504 A | | 2/1979 | Anderson | |
| 4,221,334 A | | 9/1980 | Christopher | |
| 4,347,981 A | | 9/1982 | Hayes | |
| 4,461,426 A | | 7/1984 | Christopher | |
| 4,534,512 A | | 8/1985 | Chow et al. | |
| 4,562,967 A | | 1/1986 | Grothe et al. | |
| 4,613,080 A | | 9/1986 | Benson et al. | |
| 4,666,085 A | | 5/1987 | Liaw | |
| 4,717,074 A | | 1/1988 | Karliner et al. | |
| 4,890,792 A | | 1/1990 | Martin et al. | |
| 4,903,897 A | | 2/1990 | Hayes | |
| 5,054,690 A | | 10/1991 | Olson | |
| 5,253,807 A | | 10/1993 | Newbegin | |
| 5,501,400 A | | 3/1996 | Kuo | |
| 5,540,386 A | | 7/1996 | Roman | |
| 5,566,886 A | | 10/1996 | Wang | |
| 5,598,978 A | | 2/1997 | Wang | |
| 5,683,035 A | | 11/1997 | Wang | |
| 5,746,375 A | | 5/1998 | Guo | |
| 5,772,121 A | | 6/1998 | Wang | |
| 5,823,442 A | | 10/1998 | Guo | |
| 5,884,847 A | | 3/1999 | Christopher | |
| 5,992,762 A | | 11/1999 | Wang | |

FOREIGN PATENT DOCUMENTS

| | | |
|---|---|---|
| DE | 24 08 316 | 9/1975 |
| FR | 1371366 | 12/1964 |
| SE | 128693 | 6/1950 |

* cited by examiner

*Primary Examiner*—Lesley D. Morris
*Assistant Examiner*—Dinh Q. Nguyen
(74) *Attorney, Agent, or Firm*—Cummings & Lockwood

(57) ABSTRACT

The present invention provides for a nozzle assembly including a body having a conduit extending from an inlet to an outlet. A first end of a shaft is mounted to the body and a second end of the shaft extends from the body proximate the outlet. The shaft is moveable between a retracted position and an extended position. A turret is rotationally mounted on the second end of the shaft and a plurality of nozzles are removeably mounted on the turret for alignment with the outlet. The nozzle that is aligned with the outlet sealingly mates with the outlet when the turret in the retracted position and is spaced from the outlet when the turret in the extended position.

26 Claims, 13 Drawing Sheets

NOZZLE ASSEMBLY WITH AN EXTENDABLE TURRET

BACKGROUND OF THE INVENTION

1. Field of the Invention

The present disclosure relates, in general, to a spraying device, such as a nozzle, a sprayer, a sprinkler or a shower head. Even more particularly, the present disclosure relates to a nozzle assembly with an extendable turret having differently configured, and/or sized nozzles arrayed in an extendable turret that can be rotated to align one of the different nozzles with a source of pressurized fluid.

2. Background of the Related Art

Nozzles, sprinklers, sprayers and shower heads are used during machining and manufacturing processes, for agriculture production, lawn care and gardening, and for bathing, for example. Nozzles are used to produce a fan spray of droplets from a solid stream of pressurized liquid, and can be configured or "sized" to produce different fan spray patterns, different flow rates and/or different droplet sizes.

Raindrop™ brand nozzles, available from Delavan Spray Technologies, a division of Coltec Industries Inc of Monroe, N.C., for example, are provided in a variety of configurations to provide different flow rates, fan spray patterns and/or droplet sizes. Each nozzle includes a tubular nozzle body, and a pre-orifice fitting and a nozzle insert received in opposing ends of the nozzle body. The nozzle insert has an elliptical orifice formed by a V-shaped groove intersecting a hemispheric cavity. The pre-orifice fitting has a pre-orifice in alignment with the elliptical orifice. During operation, the pre-orifice fitting meters liquid and directs the liquid in high velocity solid streams to impact a hemispherical surface of the hemispheric cavity, which directs the streams to collide at the elliptical orifice, which in turn discharges a single fan-spray of droplets.

A nozzle assembly is disclosed in U.S. Pat. No. 6,123,272 to Havican et al. ("the Havican device") wherein differently configured and/or sized nozzles, for example, the Raindrop™ brand nozzles, can be easily and quickly selected for use such that the nozzle assembly can provide different flow rates, fan spray patterns and/or droplet sizes. More particularly, as described in more detail herein below, the nozzle assembly includes a turret rotatably mounted on a body. The body has a face, an outlet in the face, and an annular seat in the face surrounding the outlet. A strut extends from the face of the body, while a spacer abuts the face. A compressible sealing member is positioned in the seat and, when not compressed, extends out of the seat and further from the face of the body than the spacer. The turret has a bore that is rotatably received on the strut, and the turret abuts the spacer. Nozzles are arrayed in the turret such that the nozzles sequentially align with the outlet of the body as the turret is rotated on the strut. A fastener secures the turret to the strut such that the turret compresses the sealing member to provide a fluid-tight seal between the outlet and the nozzle aligned with the outlet. According to one embodiment, the nozzle assembly further includes structure for indexing the rotation of the turret with respect to the body. According to another embodiment, the nozzles are removably mounted within the turret.

A disadvantage of the Havican device is that the sealing member can be damaged when the turret is rotated about the strut. More specifically, as the turret is rotated to align a nozzle with the outlet of the body, the circumferential edge around the bottom of the nozzle that is to be aligned has a tendency to cut into the sealing member, thereby causing the seal between the nozzle and the outlet of the body to be compromised. Another disadvantage of the Havican device is that the sealing member can be twisted when the turret is rotated about the strut. More specifically, as the turret is rotated to align a nozzle with the outlet of the body, the bottom of the nozzle that is to be aligned tends to twist the sealing member in its seat. A device is disclosed herein below that overcomes these disadvantages in the prior art.

SUMMARY OF THE INVENTION

Accordingly, the present disclosure provides a nozzle assembly including a body having a conduit extending between an inlet and an outlet. A first end of a shaft is mounted to the body and a second end of the shaft extends from the body proximate the outlet. The shaft is moveable between a retracted position and an extended position. A turret is rotationally mounted on the second end of the shaft and a plurality of nozzles are mounted on the turret for alignment with the outlet. When the turret in the retracted position the nozzle that is aligned with the outlet is sealingly mated with the outlet. When the turret in the extended position the nozzle that is aligned with the outlet is spaced from the outlet.

According to another aspect of the present disclosure a spring is mounted on the second end of the shaft between the body and the turret for biasing the turret to the extended position. In addition, a disk is mounted on the second end of the shaft between the spring and the turret for retaining the nozzles in the turret.

According to a further aspect of the present disclosure a cam mounted on the body and includes radially-extending flat and pitched portions. In addition, an actuator, such as a handle, is mounted on the first end of the shaft. The actuator includes a follower for engaging the flat and pitched portions of the cam. The follower is moved from the pitched portion to the flat portion to retract the turret and moved from the flat portion to the pitched portion to extend the turret.

According to yet a further aspect of the present disclosure the shaft extends through a tubular strut which includes a first end fixedly mounted to the body and a second end extending from the body proximate the outlet. In addition, the turret is rotatably mounted on the second end of the tubular strut and a spring is mounted on the second end of the tubular strut between the body and the turret. A fastener is attached to the second end of the shaft for retaining the turret on the tubular strut.

A further aspect of the present disclosure provides for a notch in the turret for each nozzle. An alignment pin is resiliently mounted to the body and is engageable with each notch to retain alignment of the corresponding nozzle with the outlet.

Yet a further aspect of the present disclosure includes receptacles in which each nozzle is removeably mounted. Each receptacle includes a ledge and each nozzle includes a base configured for engaging the ledge of each receptacle. A disk is mounted on the second end of the shaft between the body and the turret. The disk contacts the base of each nozzle to retain each nozzle in its respective receptacle.

BRIEF DESCRIPTION OF THE FIGURES

So that those of ordinary skill in the art to which the subject invention pertains will more readily understand how to make and use the nozzle assembly with an extendable turret, preferred embodiments of the invention are described in detail herein with reference to the following figures, wherein.

DETAILED DESCRIPTION OF THE PREFERRED EMBODIMENTS

Figure 1:
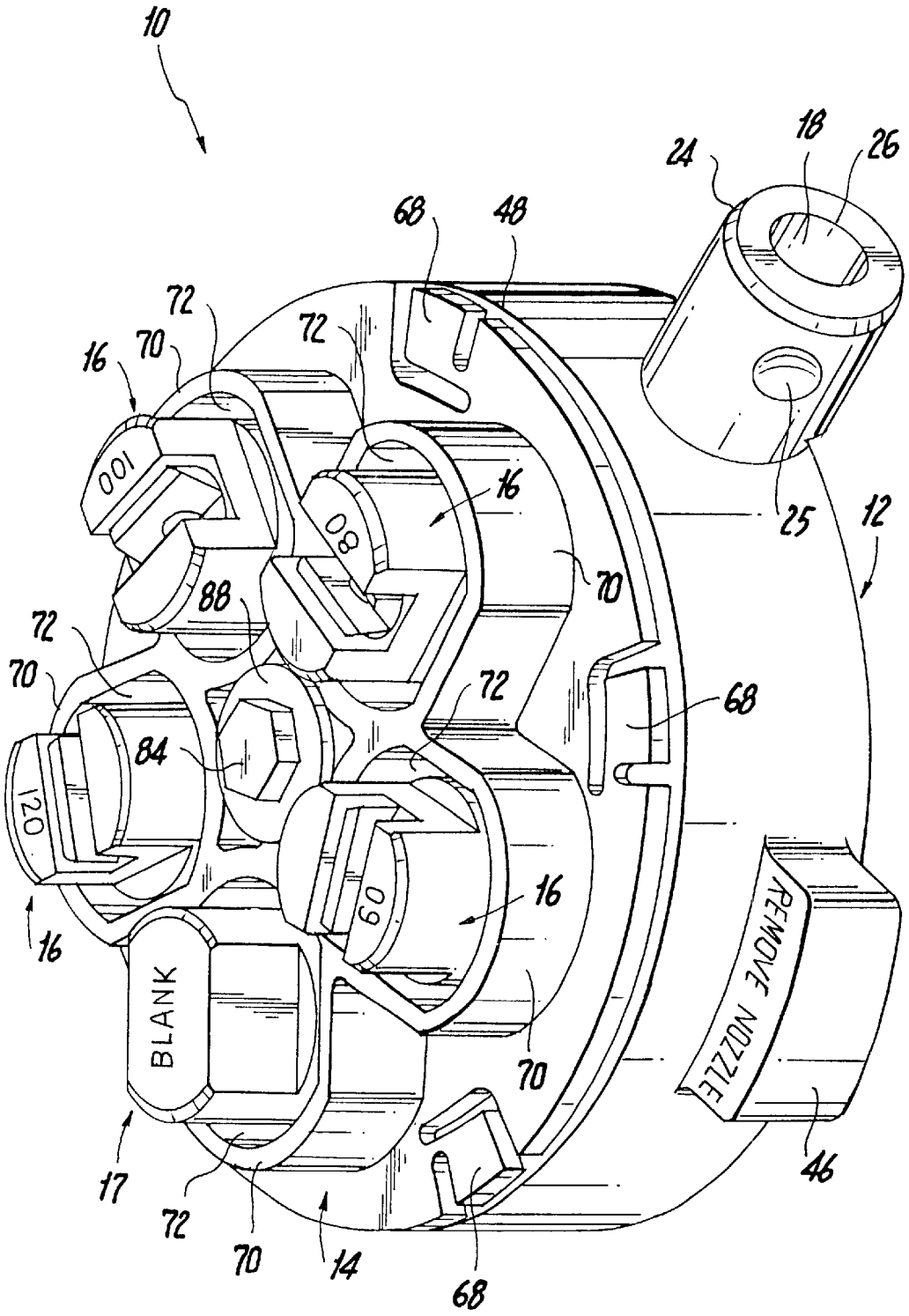
Fig. 1 (Prior Art)
FIG. 1 shows a perspective view of a prior art nozzle assembly.
Figure 2:
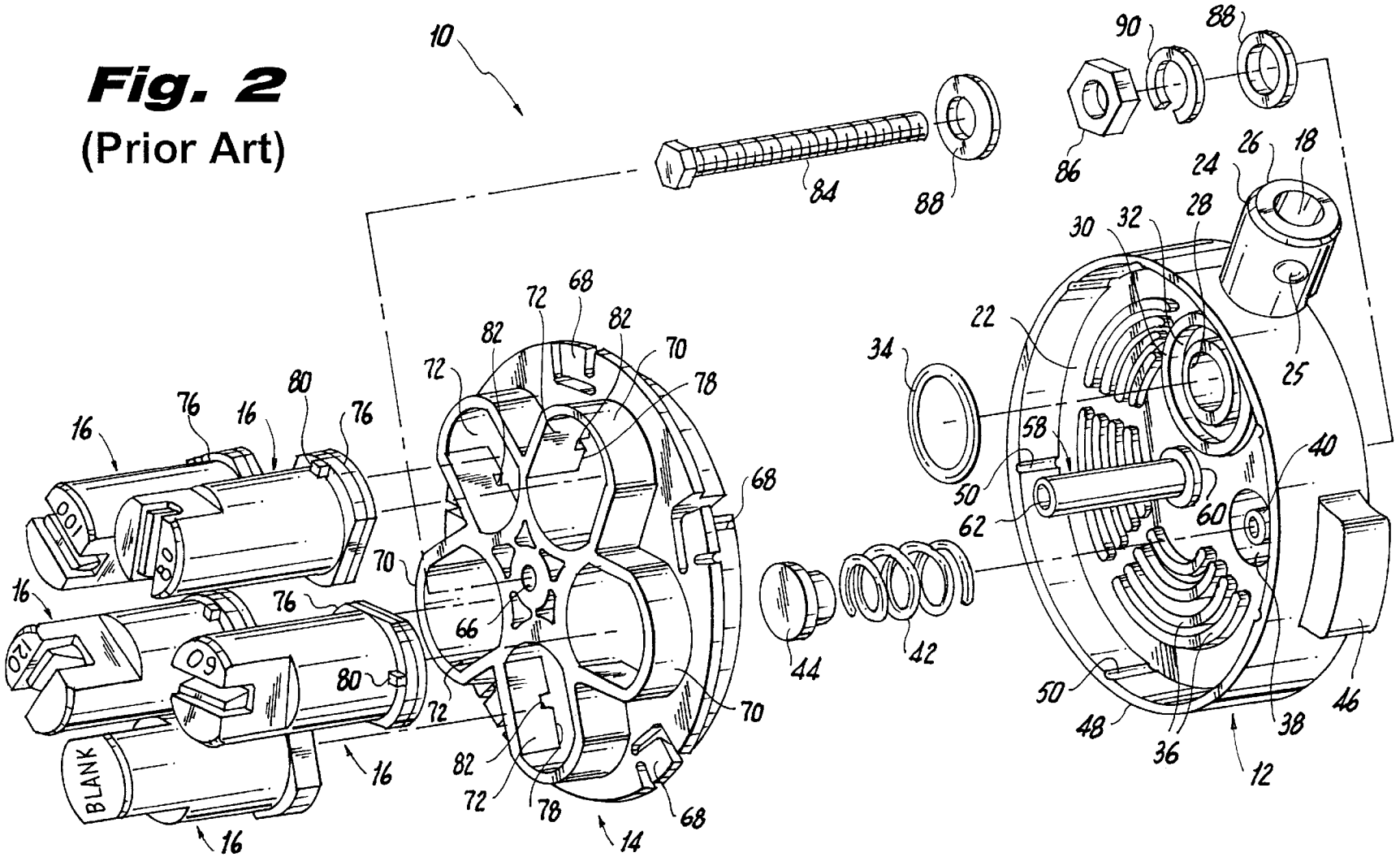
Fig. 2 (Prior Art)
FIG. 2 shows an exploded perspective view of the prior art nozzle assembly illustrated in FIG. 1.
Figure 3:
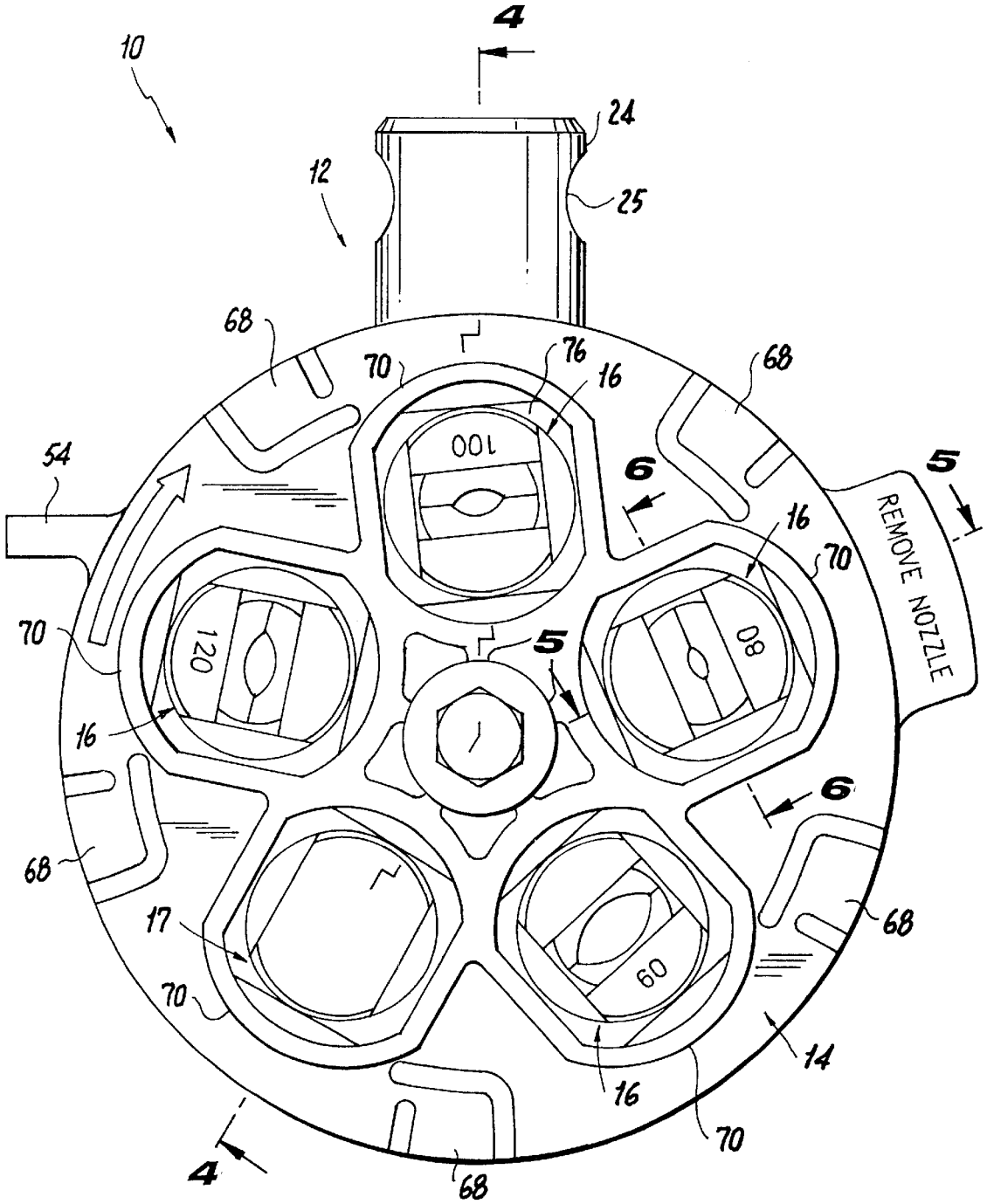
Fig. 3 (Prior Art)
FIG. 3 shows a plan view of the prior art nozzle assembly illustrated in FIG. 1.
Figure 4:
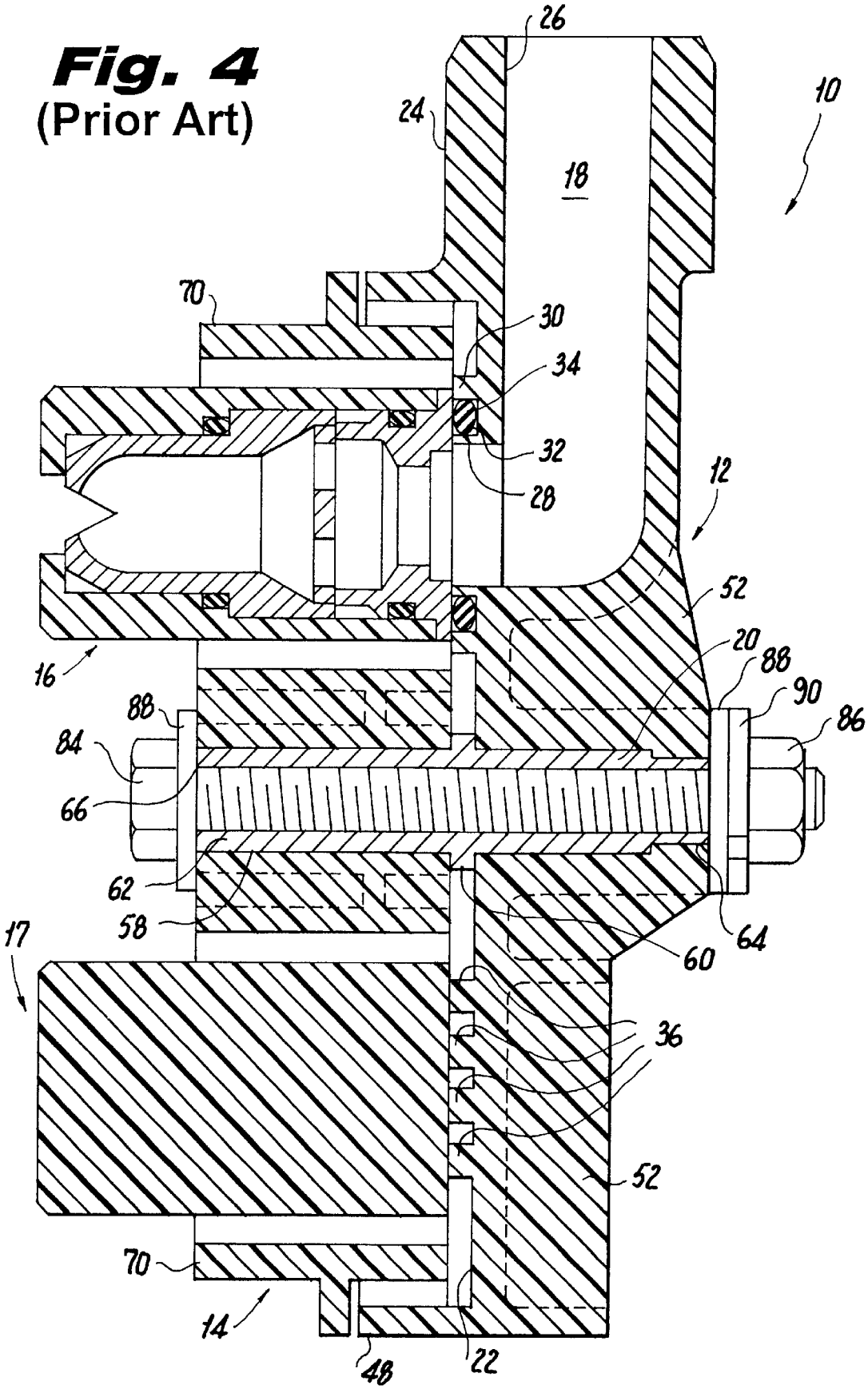
Fig. 4 (Prior Art)
FIG. 4 shows a sectional view of the prior art nozzle assembly as viewed along line 4—4 of FIG. 3.
Figure 5:
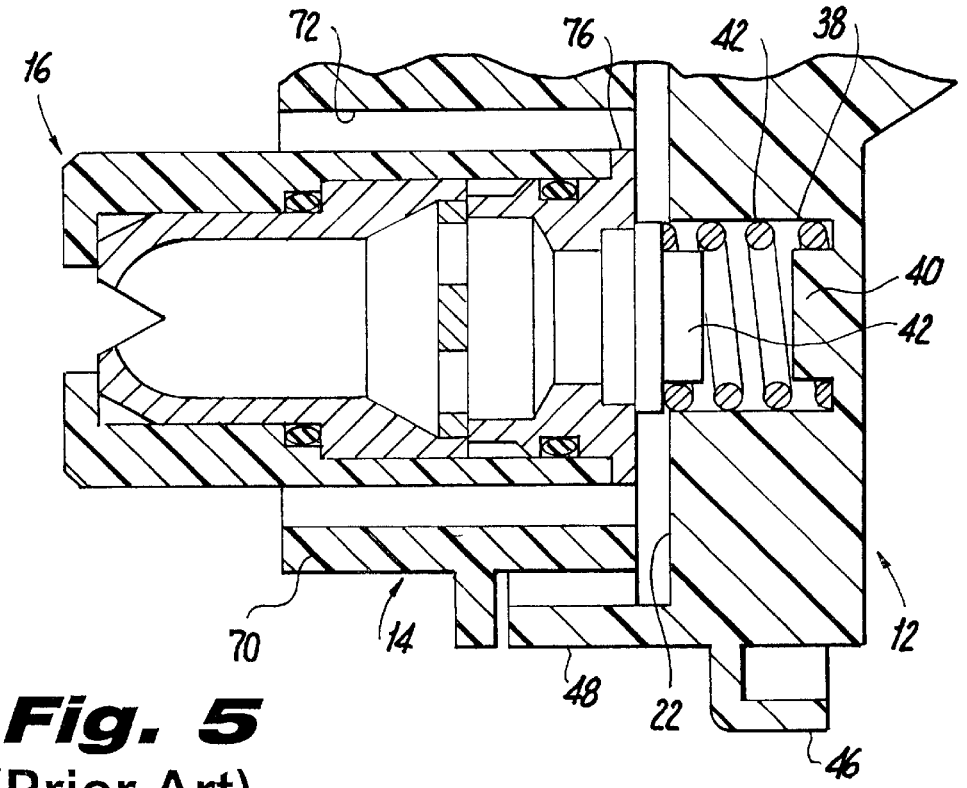
Fig. 5 (Prior Art)
FIG. 5 shows a sectional view of the prior art nozzle assembly as viewed along line 5—5 of FIG. 3.
Figure 6:
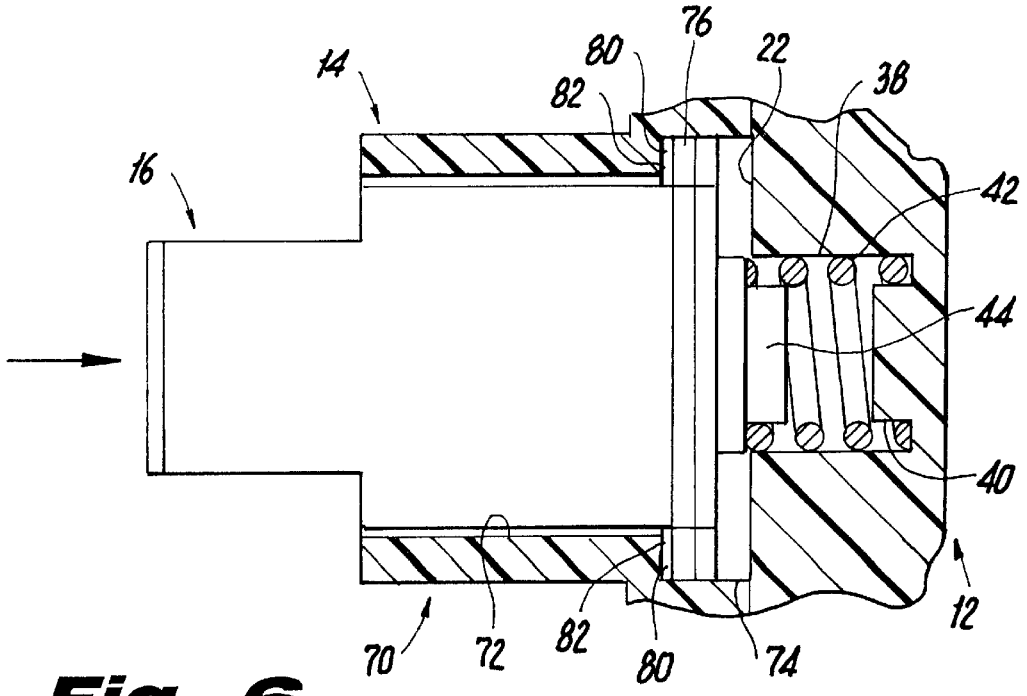
Fig. 6 (Prior Art)
FIG. 6 shows a sectional view of the prior art nozzle assembly as viewed along line 6—6 of FIG. 3.

Referring to FIGS. 1 through 6, an embodiment of a nozzle assembly 10 from U.S. Pat. No. 6,123,272 is illustrated, the contents of which are incorporate by reference herein. The nozzle assembly 10 includes a body 12, a nozzle turret 14 rotatably secured to the body, and different sized nozzles 16 arrayed in the turret. The turret 14 rotates such that one of the nozzles 16 can be aligned with a conduit 18 of the body 12. In this way, flow rate and droplet size of spray from the nozzle assembly 10 can be easily changed with a turn of the turret 14 to sequentially align the different sized nozzles 16 with the conduit 18 of the body 12. In addition to the nozzles 16, the assembly 10 can include a "blank" or solid insert 17 for sealing the conduit 18 of the body 12 when aligned therewith.

The body 12 is generally circular and includes a centrally located bore 20 that extends through the body to a face 22. A tube 24 extends radially outwardly from the body and the conduit 18 extends from an inlet 26 of the tube to an outlet 28 in the face 22 of the body 12. The tube 24 has a narrowed portion 25 such that the tube can be secured by a lock-type connector in a fluid-tight manner to a source of pressurized fluid for spraying, such as a hose, pipe or tank. A raised shoulder 30 extends from the face 22 around the outlet 28 of the conduit 18 and has a seat 32. A compressible sealing member 34 having a thickness greater than a depth of the seat 32 is positioned in the seat. The body 12 also includes a plurality of ribs 36 extending from the face 22 to a height equal to a height of the raised shoulder 30 surrounding the outlet 28. An annular wall 48 extends from and circles the face 22.

The assembly 10 includes a tubular strut 58 having opposing first and second ends 62, 64, and a relatively non-compressible annular spacer 60 radially extending outwardly from the strut and dividing an outer surface of the strut between the first and the second ends. The second end 64 of the strut 58 is secured within the bore 20 of the body 12, with the annular spacer 60 abutting the face 22 of the body. The strut 58 and the spacer 60 are preferably formed as a single piece from stainless steel.

The annular spacer 60 of the strut 58 has a thickness not greater than the height of the raised shoulder 30 surrounding the outlet 28 of the body. Thus, in a non-compressed state, the sealing member 34 extends from the raised shoulder 30, surrounding the outlet 28, further from the face 22 of the body 12 than the annular spacer 60. As shown, the sealing member preferably is provided in the form of an o-ring 34.

The nozzle turret 14 includes a centrally located bore 66 which is received on the first end 62 of the strut 58 such that the turret fits within the annular wall 48 of the body 12 and abuts the o-ring 34 extending from the raised shoulder 30 surrounding the outlet 28. A bolt 84 extends through the tubular strut 58 and is fastened with a nut 86 to secure the nozzle turret 14 to the body 12. Flat washer 88 and a lock washer 90 are used with the nut 86 and bolt 84, as shown. The nut 86 is tightened at least until the turret 14 compresses the o-ring 34. If there are indications of fluid leakage, the nut 86 can be further tightened until the turret abuts the annular spacer 60, the ribs 36 and the raised shoulder 30 extending from the face of the body 12, such that the o-ring 34 is further compressed.

The portion of the strut 58 between the first end 62 and the spacer 60 is at least as long as the bore 66 of the nozzle turret 14, such that the strut acts as a compression limiter so that the nut 86 can be somewhat over-tightened on the bolt 84 without fear of cracking the turret. Preferably, the strut 58 between the first end 62 and the spacer 60 is longer than the bore 66, such that the strut acts as a compression limiter, yet allows the turret 16 to compress the o-ring 34 to provide a fluid-tight seal. Since the annular cam 60 of the strut 58 is relatively non-compressible, the cam also provides structural stability and evenly spaces the turret 14 from the body 12 regardless of how tight the nut 86 is turned on the bolt 84. The portion of the strut 58 between the second end 64 and the spacer 60 is at least as long as the bore 20 of the body 12.

The assembly 10 also includes means for indexing the rotation of the turret 14 with respect to the body 12 such that the nozzles 16 are precisely aligned with the conduit 18. The means for indexing preferably comprises a plurality of spaced-apart inwardly faced notches 50 in the annular wall 48 of the body 12, which are engaged by resilient detents 68 extending from the outer periphery of the turret 14 to hold the turret in position with respect to the body. A user can manually rotate the turret 14 in an indexed manner with respect to the body 12 by providing enough torque to overcome the resilience of the detents 68. Alternatively, the detents can be provided on the body 12 and the notches provided on the turret 14.

The assembly 10 is designed such that the nozzles 16 and the solid insert 17 can be quickly and easily inserted into and removed from the assembly 10. As shown, the turret 14 includes a plurality of nozzle receptacles 70 arrayed around the centrally located bore 66. Each receptacle 70 has inner and outer portions 74, 72. The outer portions 72 each have an oblong cross-section, which forms ledges 78, while the inner portions 74 each have a circular cross-section. Each ledge 78 includes a notch 82.

The nozzles 16 and the solid insert 17 each have a radially extending, oblong base 76, 77, respectively, which match the oblong cross-sections of the outer portions 72 of the nozzle receptacles 70. Thus, the nozzles 16 and solid insert 17 are inserted, base-first, through the outer portions 72 of the receptacles 70 and rotated in the inner portions 74, such that the radially extending oblong bases 76,77 of the nozzles 16 and the solid insert 17 catch on the ledges 78 to secure the nozzles and the solid insert in the receptacles 70. The bases 76, 77 of the nozzles 16 and the solid insert 17 include projections 80 which engage the notches 82 in the ledges 78 of the receptacles 70 such that the nozzles must be pushed inwardly, until the projections 80 clear the notches 82, before being rotated to remove the nozzles and the blank insert from the receptacles. Thus, the nozzles 16, solid insert 17, and receptacles 70 are configured for a "twist and lock" engagement between the removable nozzles, solid insert, and the receptacles.

To assist in the removal and insertion of the nozzles 16 and solid insert 17 into the turret 14, a spring bore 38 is located in the face 22 of the body 12, and includes a boss 40 which receives a spring 42 that in turn biases a button 44 out of the spring bore. The button 44 is biased outwardly generally to a height of the ribs 36, the raised shoulder 30 and the annular spacer 60. A handle 46 extends radially outwardly from the body 12, in alignment with the spring bore 38.

During operation, the turret 14 is rotated with respect to the body 12 until a desired nozzle 16 is aligned with the outlet 28 of the conduit 18 of the body, i.e. in alignment with the tube 24 extending from the body. When a nozzle 16 is aligned with the outlet 28, the base 76 of the nozzle 16 compresses the o-ring 34 surrounding the outlet 28 to provide a fluid-tight passage from the conduit through the nozzle. When the solid insert 17 is aligned with the outlet 28, the base 77 of the insert 17 compresses the o-ring 34 surrounding the outlet 28 to provide a fluid-tight seal of the outlet.

When a selected nozzle 16 or solid insert 17 is to be removed, the turret 14 is rotated until the selected nozzle or solid insert is aligned with the spring-biased button 44, i.e. aligned with the handle 46 extending from the body 12. The nozzle 16 or solid insert 17 is then depressed against the button 44, until the projections 80 of the base 76, 77 of the nozzle or solid insert disengage, or clear, the notches 82 of the ledges 78 of the receptacle 70. While still depressing the nozzle 16 or solid insert 17, the nozzle or solid insert is turned until the oblong base 76, 77 clears the ledges 78 and aligns with the oblong outer portion 72 of the receptacle 70 so that the nozzle or solid insert can be pulled out of the receptacle.

The turret 14 and the body 12 of the assembly 10 are both preferably formed from a light-weight, rigid, strong, and corrosion-resistant material, such as plastic or reinforced plastic. If used in applications where durability or cleanness, for example, are more of a factor than cost, the nozzle turret 14, the body 12, the nozzles 16, and the solid insert 17 can all be made of a metal, such as stainless steel, aluminum, brass or copper. The body 12 further includes structural strengthening webs 52. A tab 54 extends outwardly from the body 12 and has a hole 56 there through. The tab 54 is used to attach a safety line to the assembly 10 such that the assembly does not become lost, if it is knocked lose from a tractor for example, during a fertilizing or irrigation process.

Referring to FIGS. 9 through 14 there is shown an embodiment of a nozzle assembly with an extendable turret 100. The embodiment includes a body 112, a nozzle turret 114 rotatably mounted on the body, and different size nozzles 16 arrayed in the turret. Similar to prior art nozzle assembly 10 described herein above, flow rate and droplet size of spray from the nozzle assembly 100 can be easily changed by rotating the turret 114 to sequentially align the different sized nozzles 16 with a conduit 118 formed in the body 112. Unlike the prior art nozzle assembly 10, however, nozzle assembly 100 includes a mechanism for moving the turret 114 between a retracted position and an extended position.

Generally, when the turret 114 is retracted toward the body 112, fluid may flow between the conduit 118 and the nozzle 16 aligned therewith without leakage. On the other hand, when the turret 114 is extended away from the body 112, the seal between the conduit 118 and the nozzle 16 aligned therewith is broken, the turret can be rotated, and the nozzles can be removed or inserted. The mechanism for extending and retracting the turret 114 is described in more detail herein below.

The body 112 is generally circular and includes a centrally located counter-bore 120 that extends from a face 121 of the body. A bore 122 extends concentrically from the base of the counter-bore 120 through the body 112. A tube 124 extends radially outwardly from the body 112 and the conduit 118 extends from an inlet 126 of the tube to an outlet 128 in the face 121 of the body 112. A raised shoulder 130 encircles the outlet 128 of the conduit 118 and defines a seat 132. A compressible sealing member 134 having a thickness greater than the depth of the seat 132 is positioned in the seat. An annular wall 148 extends from and encircles the face 121.

The assembly 100 includes a tubular strut 158 having first and second ends 162, 164, and an annular spacer 160 extending radially outwardly from the strut and dividing the strut between the first and the second ends. The second end 164 of the tubular strut 158 is pressed into bore 122 of the body 112, with the annular spacer 160 abutting the bottom of counter-bore 120 of the body.

The nozzle assembly 100 further includes a disk 166 which has a centrally located hub 167 through which a bore 168 extends. The disk 166 is mounted on the first end 162 of the tubular strut 158 through bore 168 such that the disk fits within the annular wall 148 of the body 112. The disk 166 also has a through-hole 163 that aligns with and has a diameter slightly larger than the outside diameter of the raised shoulder 130 on the face of the body 112. A spring 170 is mounted on the first end 162 of tubular strut 158 between the annular spacer 160 and a counter-bore 171 in the hub 167 of the disk 166. The spring 170 biases the disk 166 against the bottom surface of the turret 114 and at least a portion of the bottom surfaces of each nozzle 16. It is notable that even when a nozzle 16 is positioned over raised shoulder 130 of the body 112, at least a portion of the bottom surface of the nozzle rests on the disk. When the turret 114 is in the extended position, the through-hole 163 does not rise above the raised shoulder 130, therefore, the disk 166 is prevented from rotating when the turret is rotated. The disk 166 includes a cutout 165 for providing clearance between the disk and a locking mechanism (described below) when the turret 144 is in the extended position.

Figure 7:
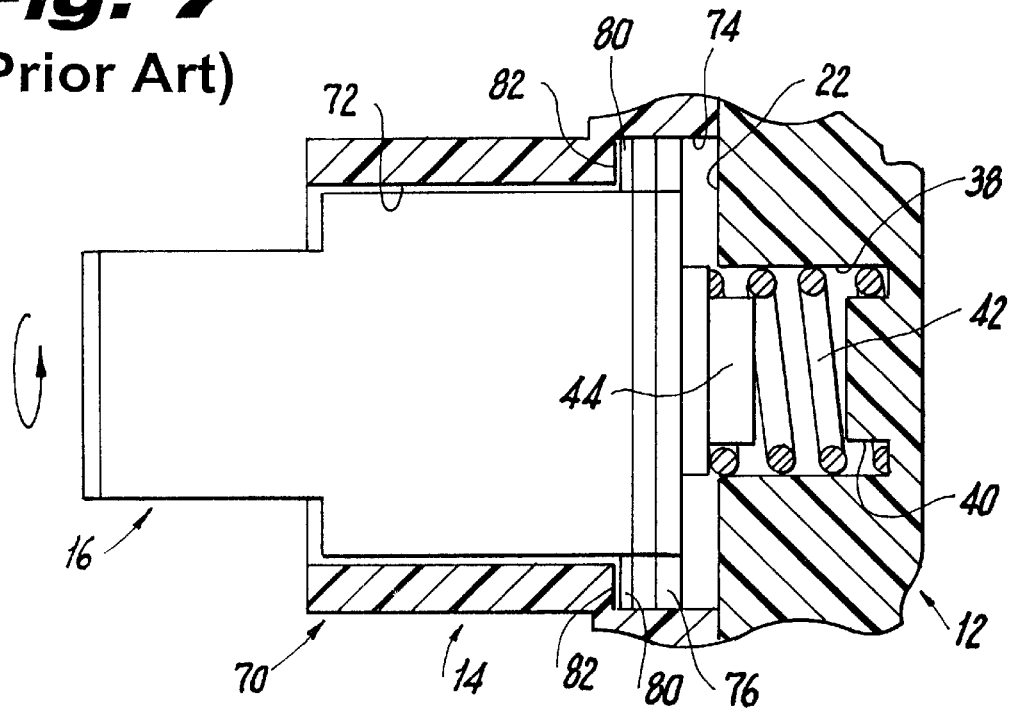
Fig. 7 (Prior Art)
FIG. 7 shows a sectional view of the prior art nozzle assembly similar to FIG. 6, however, with the nozzle pressed downward into its receptacle.
Figure 8:
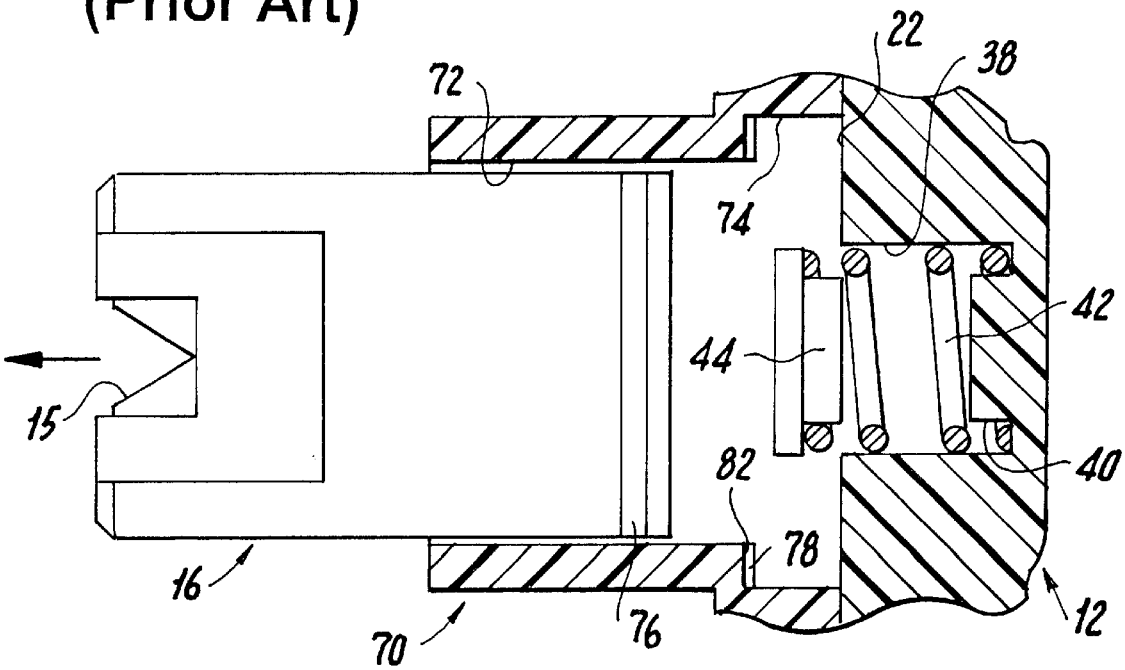
Fig. 8 (Prior Art)
FIG. 8 shows a sectional view of the prior art nozzle assembly similar to FIG. 6, however, with the nozzle rotated 90° and partially removed from its receptacle.
Figure 9:
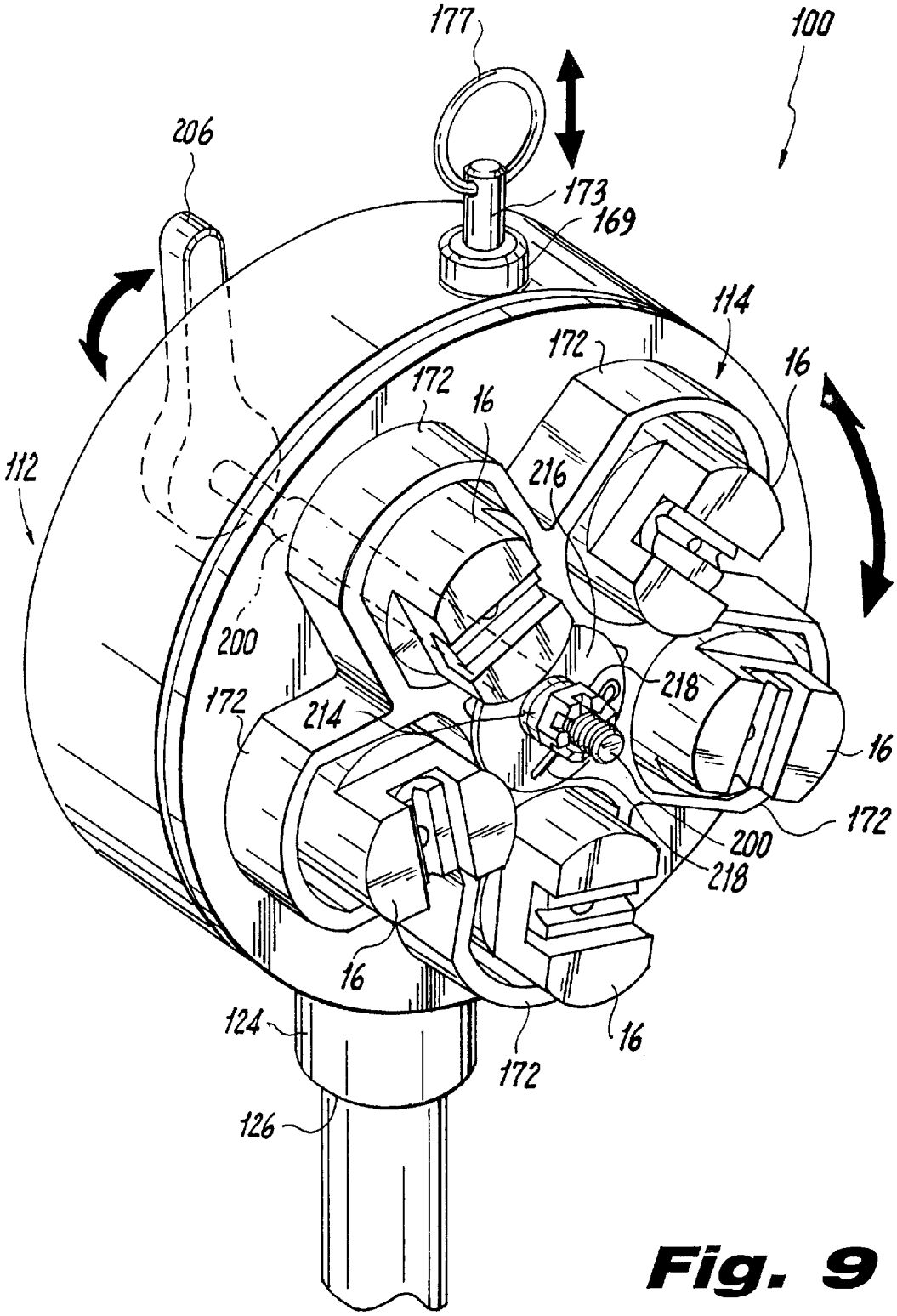
FIG. 9 shows a perspective view of an embodiment of a nozzle assembly with an extendable turret.
Figure 10:
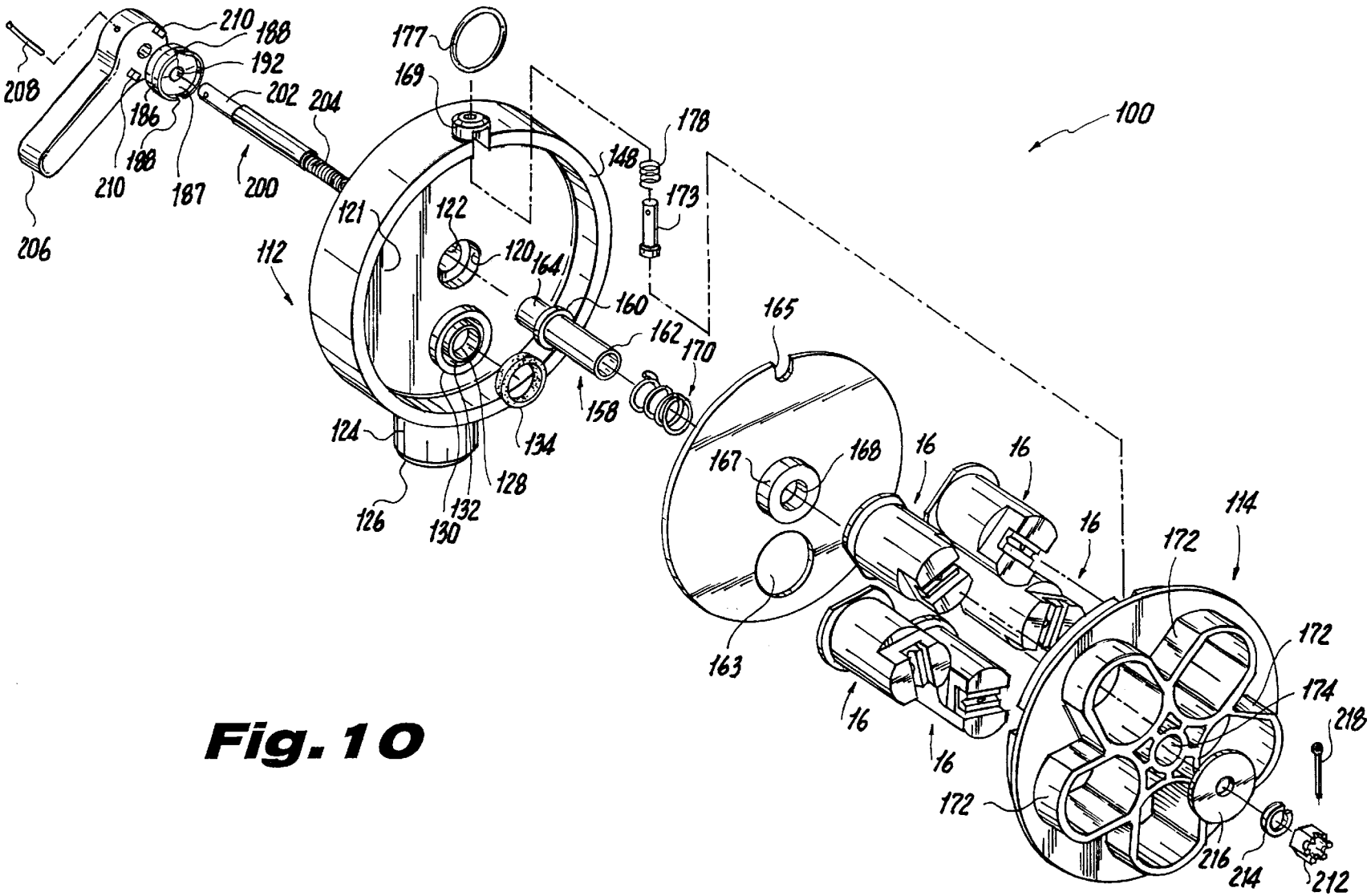
FIG. 10 shows an exploded perspective view of the nozzle assembly illustrated in FIG. 9.
Figure 11:
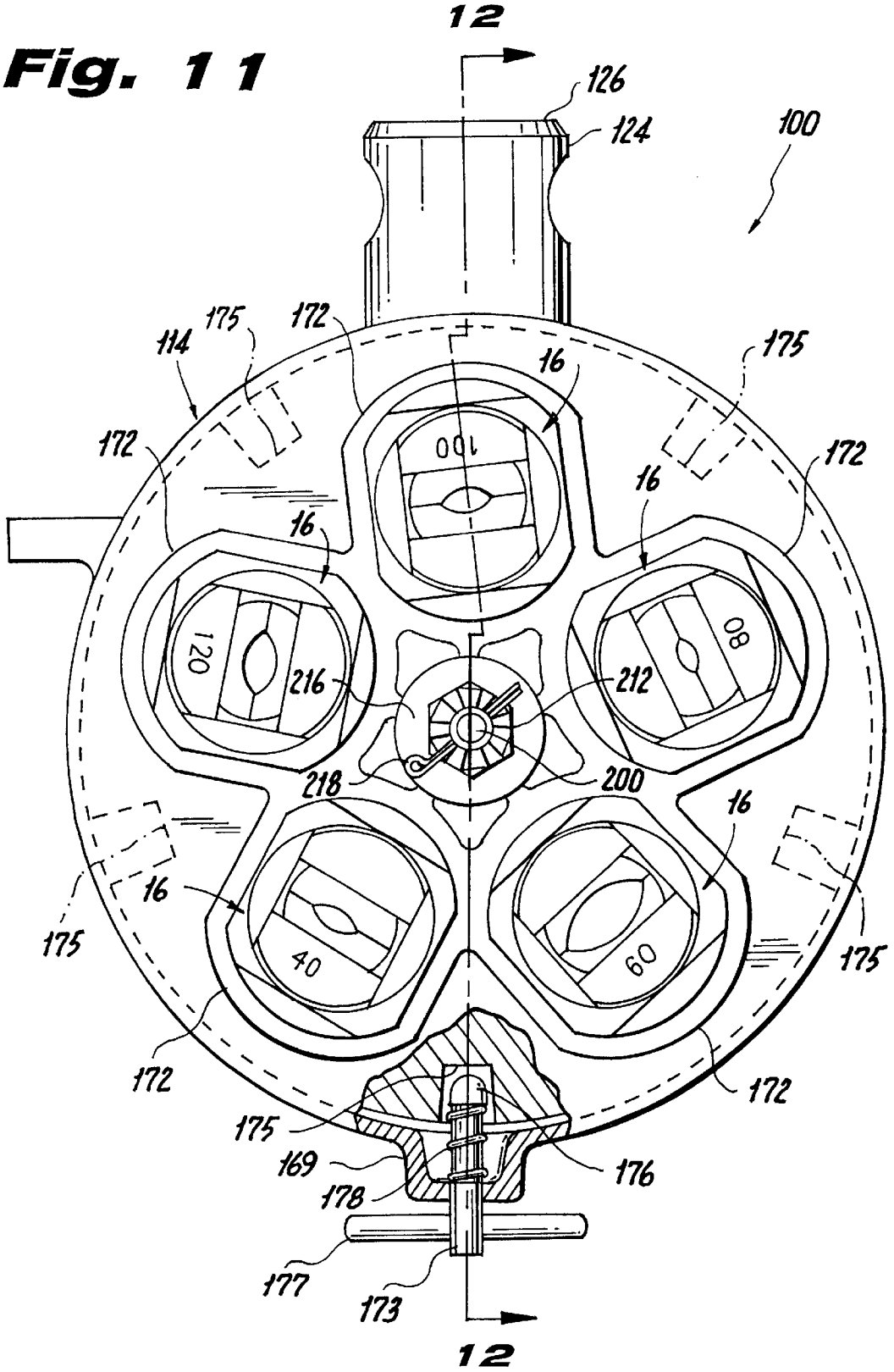
FIG. 11 shows a plan view of the nozzle assembly illustrated in FIG. 9.

The disk 166 is sufficiently flexible so the nozzles 16 can be removed/installed in a manner analogous to that described above and illustrated in FIGS. 6–8. More specifically, when the turret 114 is in the extended position (FIG. 14), a nozzle 16 can be removed by pressing it against biasing forces imposed by the disk 166, twisting the nozzle 90°, and removing the nozzle from its receptacle 172. Conversely, a nozzle 16 can be installed by inserting it in its receptacle 172, pressing the nozzle against biasing forces imposed by the disk 166, twisting the nozzle 90°, and releasing it.

Figure 12:
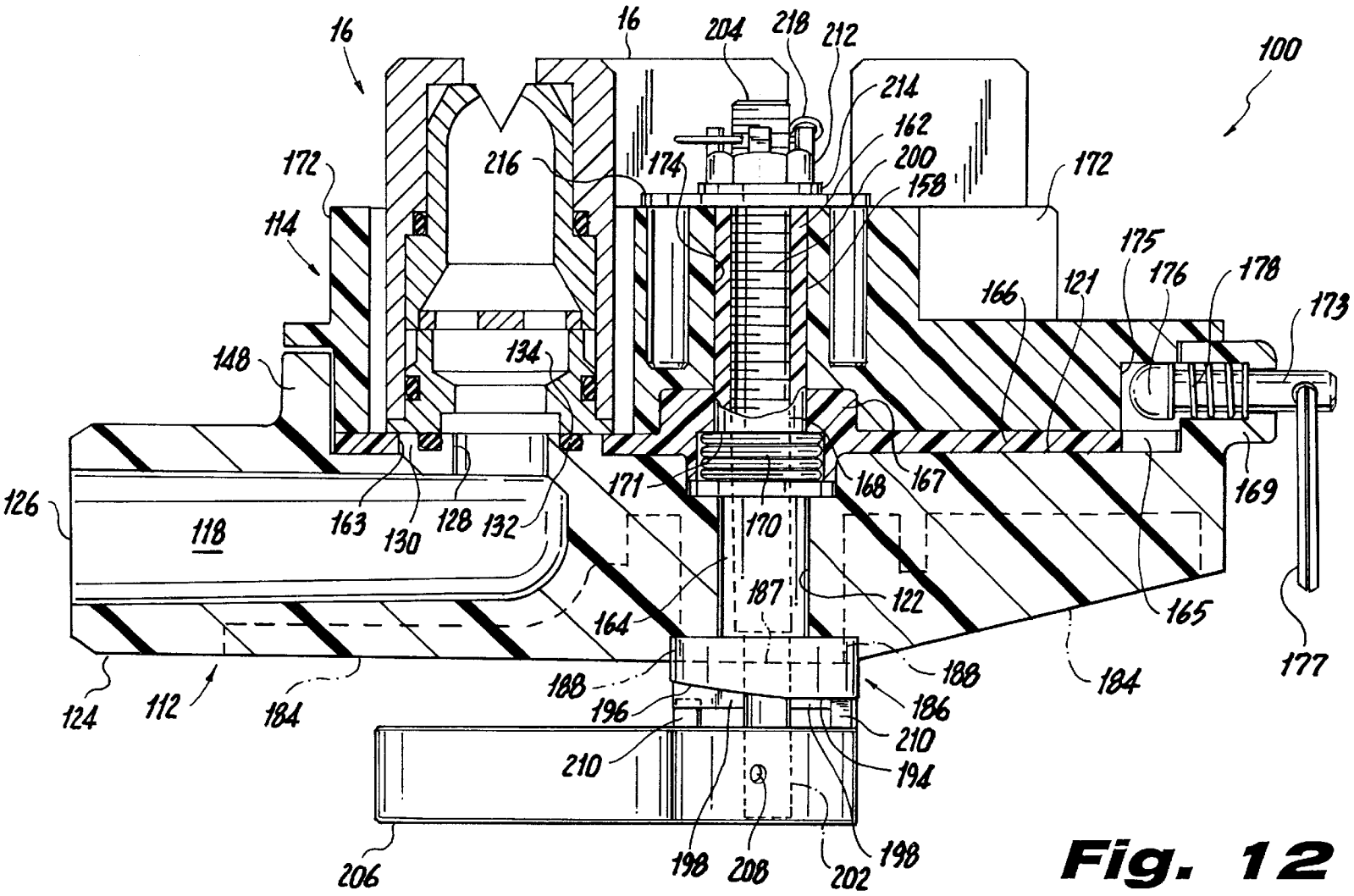
FIG. 12 shows a sectional view of the nozzle assembly as viewed along line 12—12 of FIG. 11 with the turret located in a retracted position.
Figure 13:
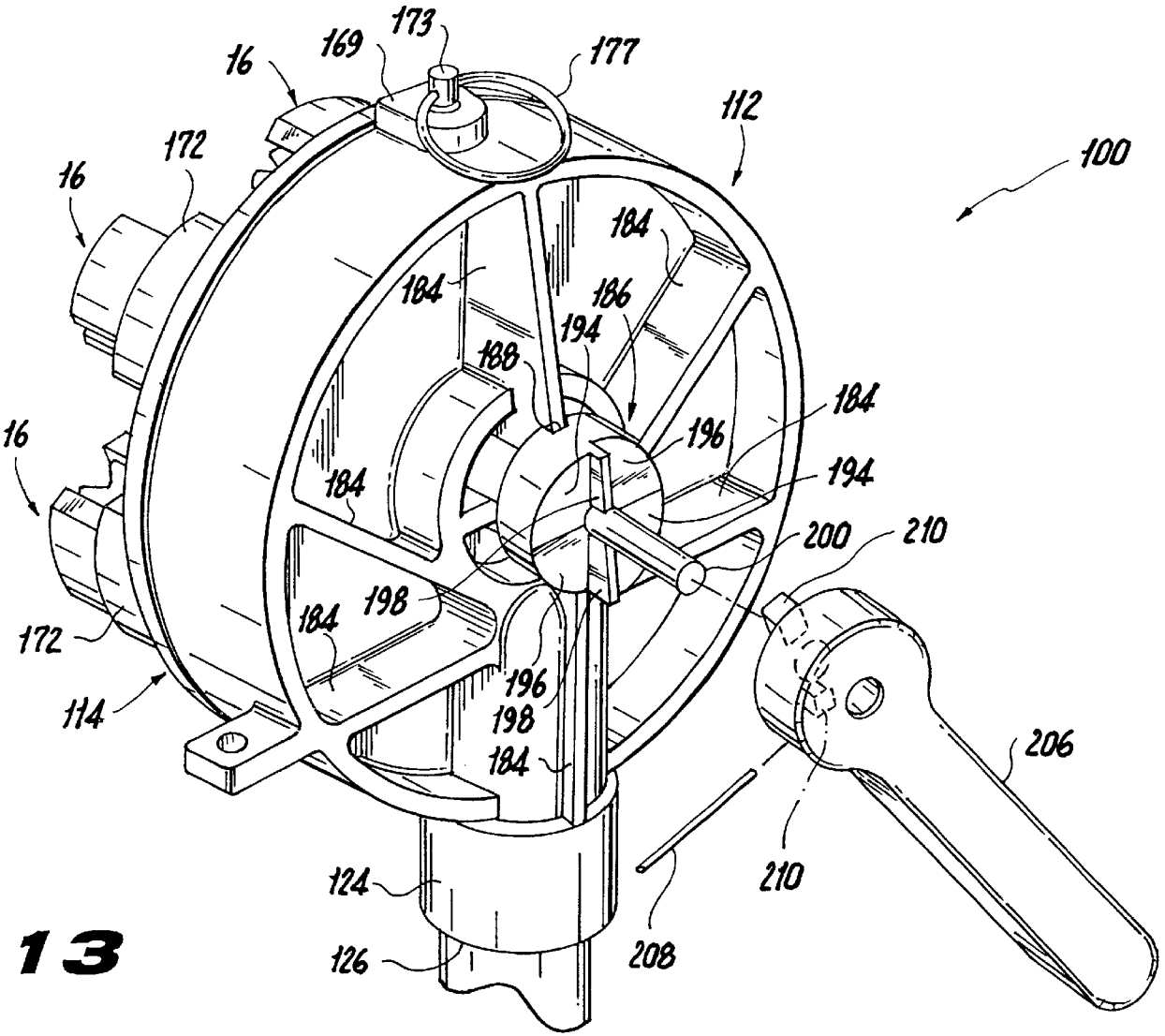
FIG. 13 shows a rear perspective view of the nozzle assembly illustrated in FIG. 9.
Figure 14:
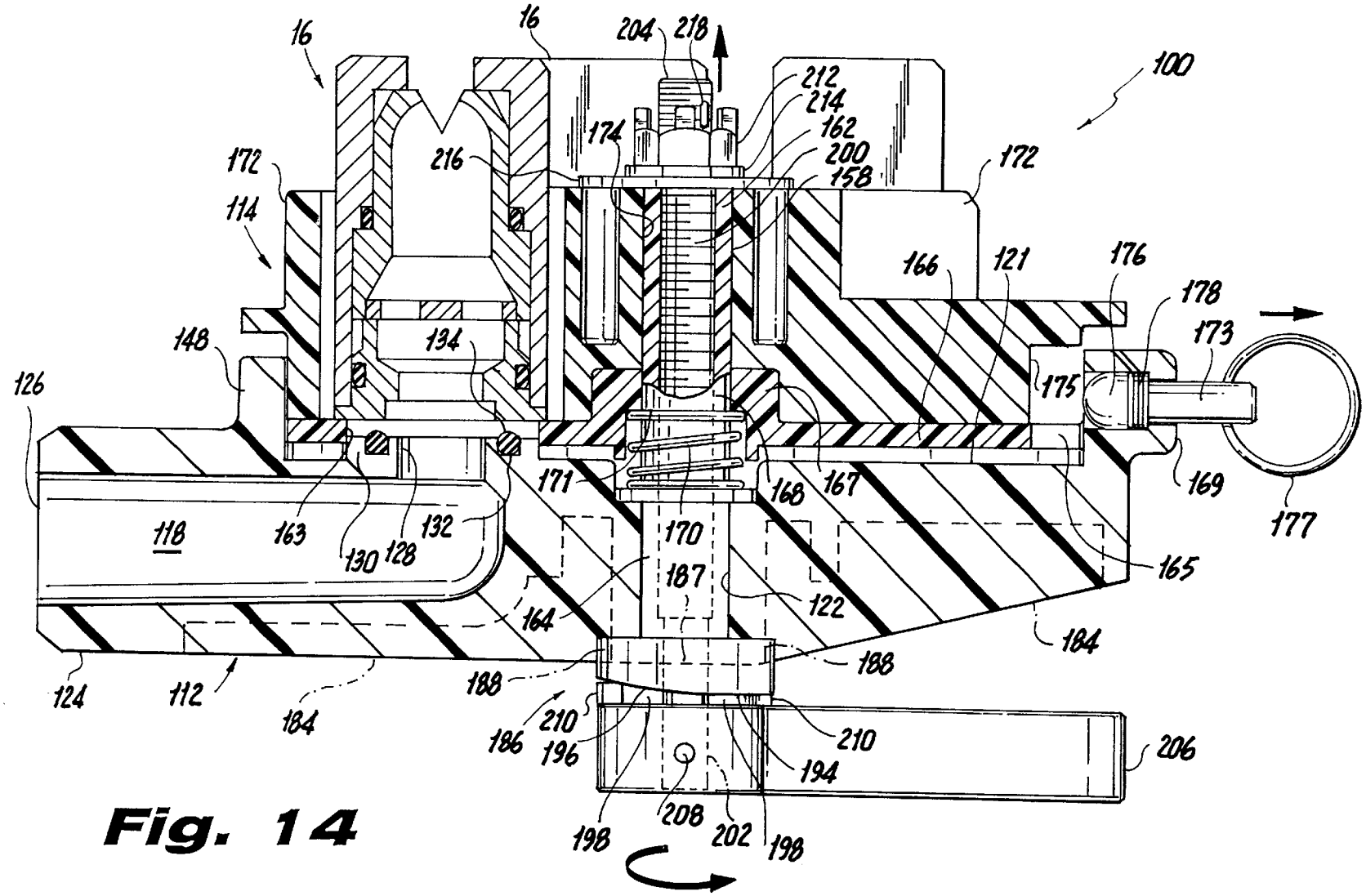
FIG. 14 shows a sectional view of the nozzle assembly similar to FIG. 12, however, with the turret located in the extended position.

When the turret 114 is in the retracted position, the disk 166 is pressed flat against the face 121 of the body 112 as shown in FIG. 12. As noted above, the disk 166 is raised from the face 121 of the body 112 when the turret 114 is in the extended position as shown in FIG. 14. The portion of the disk 166 over which the nozzles 16 pass has a thickness that is approximately equal to the height of the raised shoulder 130 on the face 121. Therefore, when the nozzle assembly 100 is in the retracted position, the disk 166 does not prevent the nozzle 16 that is aligned with the outlet 128 of the conduit 118 from sealing with the compressible sealing member 134 in raised shoulder 130.

The turret 114 includes a centrally located bore 174 which is rotatably received on the first end 162 of the tubular strut 158 such that the turret fits within the annular wall 148 of the body 112. The nozzle receptacles 172 are arrayed around the centrally located bore 174. The nozzles 16 can be quickly and easily inserted into and removed from the nozzle receptacles 172 as described above. With the nozzles 16 installed in the receptacles 172, the turret 114 can be rotated to align any one of the nozzles with the outlet 128 of the conduit 118. The turret 114 is biased upwardly by the spring 170, whose biasing force acts through disk 166.

The nozzle assembly 100 also includes a mechanism for positively locking the rotational position of the turret 114 with respect to the body 112 such that a desired nozzles 16 may be fixedly aligned with the outlet 128 of the conduit 118. The mechanism for locking includes a plurality of spaced-apart outwardly facing notches 175 in the lower outer edge of the turret 114, which are engagable with an alignment pin 173 mounted through an embossment 169 in the annular wall 148 of the body 112. Each notch 175 corresponds to a nozzle receptacle 172 in the turret 114. The alignment pin 173 has a rounded head 176 on its first end and a wire ring 177 passing through a cross-hole in its second end. A spring 178 is positioned around the alignment pin 173 between the rounded head 176 and the embossment 169 for biasing the alignment pin toward the notches 175 in the turret 114.

The bottom of the body 112 includes several ribs 184 providing structural rigidity and strength to the body. A cam 186 includes a counter-bore 187 and two notches 188 that intersect the counter-bore in a first end of the cam. The two notches 188 engage two ribs 184 of the body 112, thereby preventing rotation of the cam 186. The cam 186 also includes a bore 192 concentrically aligned with bore 122 of the body 112. The end of the cam 186 opposite the counter-bore 187 includes two complementary cams that each define a flat portion 194 and a pitched portion 196. The cams are partitioned by stop barriers 198 that extend radially from the bore 192.

A threaded shaft 200 includes a stepped end 202 and a threaded end 204 and extends through the tubular strut 158. A handle 206 is mounted on and pinned through a cross-hole with spring pin 208 to the stepped end 202 of the threaded shaft 200. The handle 206 includes two opposing followers 210 such that each follower aligns with and follows its respective flat and pitched portions 194, 196 of the cam 186 as the handle and shaft 200 are rotated. It is notable that the handle 206 may be replaced by other types of actuators. The handle may, for example, be replaced by a hand wheel or even a motor-driven gear sprocket. In such case, the actuators will include followers 210 for contacting the flat and pitched portions 194, 196 as described above. In addition, those or ordinary skill in the art will appreciate that various mechanisms can be used to move the threaded shaft 200 between the retracted and extended positions, only two of which are shown and described herein.

The threaded shaft 200 protrudes from the first end 162 of the tubular strut 158 and is secured in place with a castle nut 212. Lock and flat washers 214, 216 and a cotter key 218 are used in their usual manner to lock the castle nut 212 in position. During assembly or adjustment of nozzle assembly 100, the handle 206 should be positioned so that the followers 210 are on their respective flat portions 194 of the cam 186 against their respective stop barriers 198. Thereafter, the castle nut 212 is tightened against the turret 114 so the nozzle 16 that is aligned with the outlet 128 of the conduit 118 compresses the compressible sealing member 134 in the raised shoulder 130 to form a leak-proof seal. If there are indications of fluid leakage, the nut 212 can be further tightened to further compress the compressible sealing member 134.

During normal operation of the spray nozzle 100 the turret 114 is in the retracted position and a nozzle 16 is aligned with the conduit 118 as illustrated in FIG. 12. More particularly, during normal operation of the spray nozzle 100 the followers 210 extending from the handle 206 are each located on their respective flat portions 194 of the cam 186 and against their respective stop barriers 198, thereby causing the turret 114 and disk 166 to be retracted toward the body 112. Consequentially, the base of the aligned nozzle 16 is sealingly forced against the compressible sealing member 134 in the raised shoulder 130. Alignment between the nozzle 16 and the conduit is assured by engaging the alignment pin 173 with the notch 175 that corresponds to the aligned nozzle.

When an operator desires to spray fluid from a nozzle 16 other than the nozzle aligned with conduit 118 or to replace a nozzle installed in a receptacle 172, the turret 114 is first moved to the extended position as illustrated in FIG. 14. To move the turret 114 from the retracted position to the extended position the handle 206 is rotated so that the followers 210 of the handle are relocated from their respective flat portions 194 to their respective pitched portions 196 of the cam 186 and against their respective stop barriers 198. In the extended position, the base of the nozzle 16 is still aligned with the conduit, however, it is separated from the compressible sealing member 134 in the raised shoulder 130.

To spray fluid from a nozzle 16 other than the nozzle presently aligned with the conduit 118, the turret 114 is first extended as described above. The operator then grips and pulls the wire ring 177 away from the turret 114 to disengage the alignment pin 173 from the notch 175 that corresponds to the aligned nozzle 16. The turret 114 is then rotated until the desired nozzle 16 is aligned with the outlet 128 of the conduit 118. At such time, the wire ring 177 is released, permitting the alignment pin 173 to engage the notch 175 that corresponds to the desired nozzle 16. Thereafter, the turret 114 is moved from the extended position to the retracted position by rotating the handle 206 so that the followers 210 of the handle are relocated from their respective pitched portions 196 to their respective flat portions 194 of the cam 186 and against their respective stop barriers 198.

To replace a nozzle 16 that is installed in a receptacle 172, the turret 114 is first extended as described above. The operator then grips the nozzle 16 that is to be replaced, presses it toward the body 112, twists the nozzle 90°, and pulls the nozzle away from the body and out of the receptacle 172. If the nozzle 16 that is to be replaced is aligned with the outlet 128 of the conduit 118, the turret 114 should be rotated to relocate the nozzle to another nozzle position as described above. After the nozzle 16 to be replace is removed from the receptacle 172, a replacement nozzle can be installed in the receptacle following the above removal procedure in reverse. Thereafter, the turret 114 is moved from the extended position to the retracted position by rotating the handle 206 so that the followers 210 of the handle are relocated from their respective pitched portions 196 to their respective flat portions 194 of the cam 186 and against their respective stop barriers 198.

Figure 15:
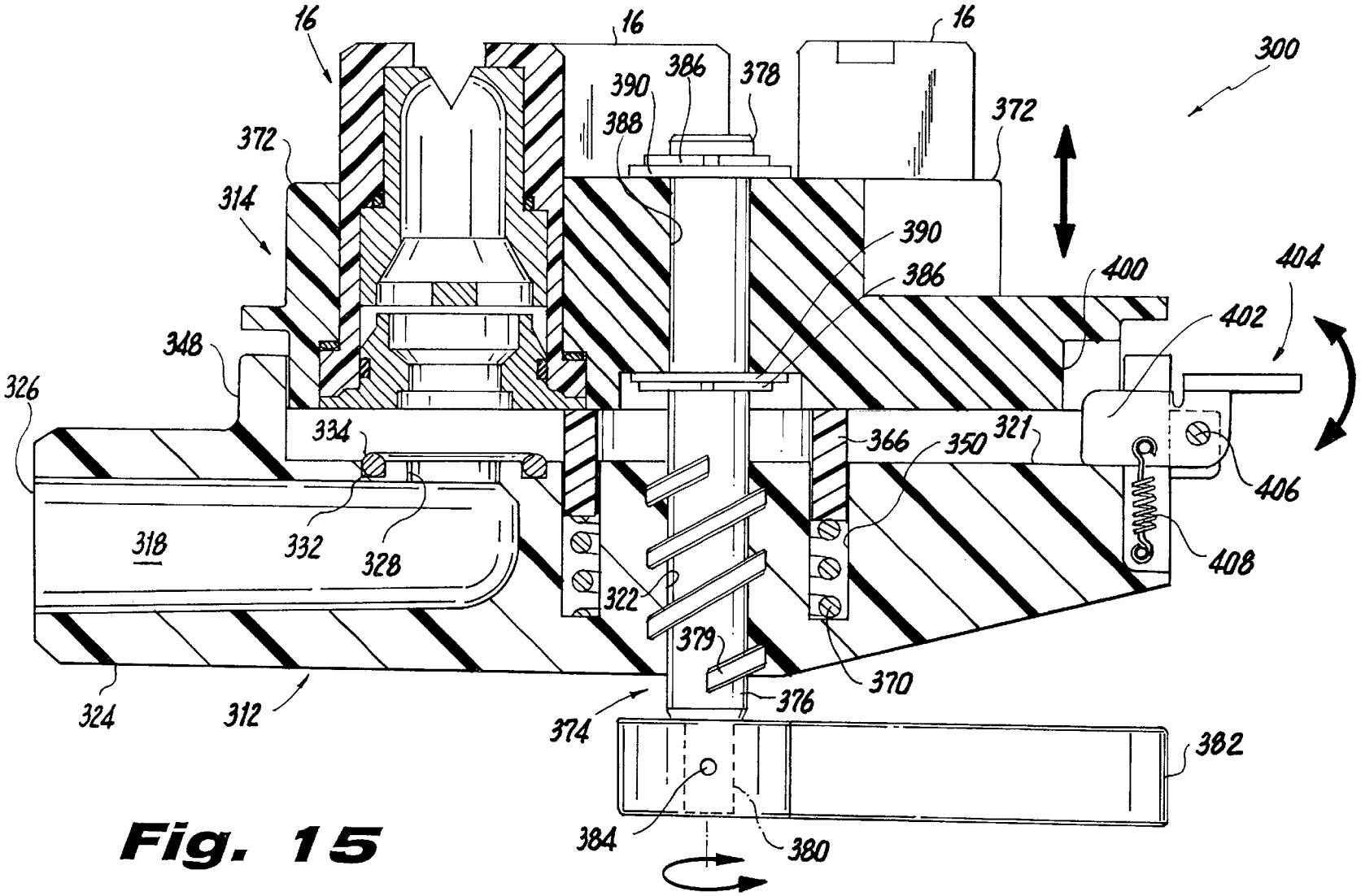
FIG. 15 shows a sectional view similar to FIG. 14, however, of another embodiment of a nozzle assembly with an extendable turret.

Referring to FIG. 15 there is shown another embodiment of a nozzle assembly with an extendable turret 300. The embodiment includes a body 312, a nozzle turret 314 rotatably mounted on the body, and different size nozzles 16 arrayed in the turret. Similar to prior art nozzle assembly 10 described herein above, flow rate and droplet size of spray from the nozzle assembly 300 can be easily changed by rotating the turret 314 to sequentially align the different sized nozzles 16 with a conduit 318 formed in the body 312. Unlike the prior art nozzle assembly 10, however, nozzle assembly 300 includes a mechanism for moving the turret 314 between a retracted position and an extended position.

Generally, when the turret 314 is retracted toward the body 312, fluid may flow between the conduit 318 and the nozzle 16 aligned therewith without leakage. On the other hand, when the turret 314 is extended away from the body 312, the seal between the conduit 318 and the nozzle 16 aligned therewith is broken, the turret can be rotated, and the nozzles can be removed or inserted. The mechanism for retracting and extending the turret 314 is described in more detail herein below.

The body 312 is generally circular and includes a centrally located threaded bore 322 that extends through the body 312. A tube 324 extends radially outwardly from the body 312 and the conduit 318 extends from an inlet 326 of the tube to an outlet 328 in a face 321 of the body 312. A seat 332 is formed around the outlet 328 and is concentric therewith. A compressible sealing member 334 having a thickness greater than the depth of the seat 332 is positioned in the seat. An annular wall 348 extends from and encircles the face 321.

The body 312 further includes a cylindrically shaped bore hole 350 located concentrically around the threaded bore 322. A collar 366 is positioned within the bore hole 350 and has a slip fit therewith. A spring 370 is positioned in the bore hole 350 between the base of the bore hole and the collar 366, thereby biasing the collar toward the bottom side of the turret 314 such that it captures the bottom edges of the nozzles 16. Consequentially, when the turret 314 is in the extended position, the nozzles 16 are retained within their respective receptacles 372 in the turret.

The collar 366 is configured so the nozzles 16 can be removed/installed in a manner analogous to that described above and illustrated in FIGS. 6–8. More specifically, when the turret 314 is in the extended position, a nozzle 16 can be removed by pressing it against biasing forces imposed by the collar 366, twisting the nozzle 90°, and removing the nozzle from its receptacle 372. Conversely, a nozzle 16 can be installed by inserting it in its receptacle 372, pressing the nozzle against biasing forces imposed by the collar 366, twisting the nozzle 90°, and releasing it. When the turret 314 is in the retracted position (not shown), the collar 366 is pressed into the bore hole 350.

A threaded shaft 374 includes a first and second end 376, 378. The first end 376 includes one or more threads 379, for example, acme threads, threadingly engaging mating threads formed in the threaded bore 322, and a stepped shoulder 380 on which a handle 382 is mounted and pinned with a spring pin 384. The second end 378 includes two channels for receiving snap clips 386.

The turret 314 includes a centrally located bore 388 which is rotatably received on the second end of the threaded shaft 378 such that the turret fits within the annular wall 348 of the body 312. A flat washer 390 is provided between the turret 314 and each snap clip 386. The nozzle receptacles 372 are arrayed around the centrally located bore 388. The nozzles 16 can be quickly and easily inserted into and removed from the nozzle receptacles 372 as described above. With the nozzles 16 installed in the receptacles 372 and the turret 314 in the extended position, the turret can be rotated to align any one of the nozzles with the outlet 328 of the conduit 318.

The nozzle assembly 300 also includes a mechanism for positively locking the rotational position of the turret 314 with respect to the body 312 such that a desired nozzles 16 may be fixedly aligned with the outlet 328 of the conduit 318. The mechanism includes a plurality of spaced-apart outwardly facing slots 400 in the lower outer edge of the turret 314, which are engagable with a blade 402 of an alignment lever 404. The slots 400 each correspond to a nozzle 16 in the turret 314 such that when a slot is aligned with the alignment lever 404, the corresponding nozzle aligns with the outlet 328. The alignment lever 404 rotates about a dowel pin 406 which is pressed into an embossment in the annular wall 348 of the body 312. The alignment lever 404 is biased by a spring 408 so that the blade 402 is maintained in the slot 400.

During normal operation of the spray nozzle 300 the turret 314 is in the retracted position and a nozzle 16 is aligned with the outlet 328 of the conduit 318. More particularly, during normal operation of the spray nozzle 300 the threaded shaft 374 is rotated to drive it toward the handle 382 side of the spray nozzle, thereby causing the turret 314 to be retracted toward the body 312. Consequentially, the base of the nozzle 16 that is aligned with the outlet 328 of the conduit 318 is forced against the compressible sealing member 334. Alignment between the nozzle 16 and the conduit is assured by engaging the blade 402 of the alignment lever 404 with the slot 400 that corresponds to the nozzle.

When an operator desires to spray fluid from a nozzle 16 other than the nozzle aligned with the outlet 328 of the conduit 118, or to replace a nozzle installed in a receptacle 372, the turret 314 is first moved to the extended position as illustrated in FIG. 15. To move the turret 314 from the retracted position to the extended position the handle 382 is rotated to drive the threaded shaft 374 toward the turret 314 side of the spray nozzle, thereby causing the turret 314 to be extended away from the body 312. In the extended position, the base of the nozzle 16 is still aligned with the outlet 328, however, the nozzle is separated from the compressible sealing member 334.

To spray fluid from a nozzle 16 other than the nozzle presently aligned with the conduit 318, the turret 314 is first extended as described above. The operator then pivots the alignment lever 404 about the dowel pin 406 so that the blade 402 no longer engages the slot 400 that corresponds to the aligned nozzle 16. The turret 314 is then rotated until the desired nozzle 16 is aligned with the outlet 328 of the conduit 318. At such time, the alignment lever 404 is released so that the blade 402 engages the slot 400 that corresponds to the desired nozzle 16. Thereafter, the turret 314 is moved from the extended position to the retracted position by rotating the handle 382 to drive the threaded shaft 374 toward the handle 382 side of the spray nozzle, thereby causing the turret 314 to be retracted toward the body 312. Consequentially, the base of the nozzle 16 that is aligned with the outlet 328 is forced against the compressible sealing member 334.

To replace a nozzle 16 that is installed in a receptacle 372, the turret 314 is first extended as described above. The operator then grips the nozzle 16 that is to be replaced, presses it toward the body 312, twists the nozzle 90°, and pulls the nozzle away from the body and out of the receptacle 372. After the nozzle 16 to be replaced is removed from the receptacle 372, a replacement nozzle can be installed in the receptacle following the above removal procedure in reverse. Thereafter, the turret 314 is moved from the extended position to the retracted position by rotating the handle 382 so that the threaded shaft 374 is driven toward the handle 382 side of the body 312, thereby causing the turret 314 to be retracted toward the body.

The principles, preferred embodiments and modes of operation of the presently disclosed nozzle assemblies have been described in the foregoing specification. The presently disclosed nozzle assemblies, however, are not to be construed as limited to the particular embodiments shown, as these embodiments are regarded as illustrious rather than restrictive. Moreover, variations and changes may be made by those skilled in the art without departing from the spirit of the presently disclosed nozzle assemblies.

What is claimed is:

1. A nozzle assembly comprising:

a body including an outlet;

a shaft having a first end mounted to the body and a second end extending from the body, wherein the shaft is moveable between a retracted position and an extended position;

a turret rotationally mounted on the second end of the shaft; and a plurality of nozzles mounted on the turret for alignment with the outlet, wherein the aligned nozzle is sealingly mated with the outlet when the shaft is in the retracted position and is spaced from the outlet when the shaft is in the extended position.

2. A nozzle assembly as recited in claim 1, further including a spring mounted on the second end of the shaft between the body and the turret for biasing the turret to the extended position.

3. A nozzle assembly as recited in claim 2, further including a disk mounted on the second end of the shaft between the spring and the turret and contacting each nozzle to retain the nozzles in the turret.

4. A nozzle assembly as recited in claim 2, further including a cam mounted on the body and having radially-extending flat and pitched portions, and an actuator mounted on the first end of the shaft and having a follower for engaging the flat and pitched portions of the cam, wherein the follower is moved from the pitched portion to the flat portion to retract the turret and moved from the flat portion to the pitched portion to extend the turret.

5. A nozzle assembly as recited in claim 2, further including a tubular strut in which the shaft is mounted, a first end fixedly mounted to the body, a second end on which the spring and the turret are mounted, and further including a fastener attached to the second end of the shaft for retaining the turret on the tubular strut.

6. A nozzle assembly as recited in claim 1, further including a raised shoulder extending from the body around the outlet and defining a seat in which a seal is mounted for sealing between the aligned nozzle and the outlet when the turret is in the retracted position.

7. A nozzle assembly as recited in claim 1, wherein the turret defines a notch corresponding to each nozzle, and further including an alignment pin mounted to the body and selectably engageable with each notch.

8. A nozzle assembly as recited in claim 1, wherein the turret further includes a plurality of receptacles, and wherein each nozzle is removeably mounted in one of the receptacles.

9. A nozzle assembly as recited in claim 8, wherein each receptacle includes a ledge and each nozzle includes a base configured for engaging the ledge of each receptacle, and further including a disk mounted on the second end of the shaft between the body and the turret and contacting the base of each nozzle to retain each nozzle in its respective receptacle.

10. A nozzle assembly comprising:

a body including a conduit extending from an inlet to an outlet;

a shaft having a first end mounted to the body and a second end extending from the body at a location proximate the outlet, wherein the shaft is moveable between a retracted position and an extended position;

a turret having a plurality of receptacles mounted thereon for alignment with the outlet and rotationally mounted on the second end of the shaft; and a plurality of nozzles removeably mounted in the receptacles, wherein the nozzle mounted in the receptacle aligned with the outlet is sealingly mated with the outlet when the shaft is in the retracted position and is spaced from the outlet when the shaft is in the extended position.

11. A nozzle assembly as recited in claim 10, further including a means for moving the shaft between the retracted position and the extended position.

12. A nozzle assembly as recited in claim 10, further including a means for locking the rotational position of the turret as each receptacle is aligned with the outlet.

13. A nozzle assembly as recited in claim 10, further including a cam mounted on the body and having radially-extending flat and pitched portions, and an actuator mounted on the first end of the shaft having one or more followers for engaging the flat and pitched portions of the cam, wherein the one or more followers are moved from the pitched portion to the flat portion to retract the turret and are moved from the flat portion to the pitched portion to extend the turret.

14. A nozzle assembly as recited in claim 10, further including a tubular strut having a first end fixedly mounted to the body, wherein the shaft extends through the tubular strut and the turret is rotatably mounted on a second end of the tubular strut, further including a spring mounted on the tubular strut between the body and the turret, and further including a fastener attached to the second end of the shaft for retaining the turret on the tubular strut.

15. A nozzle assembly as recited in claim 10, further including a raised shoulder extending from the body around the outlet and defining a seat in which a seal is mounted for sealing between the nozzle mounted to the receptacle aligned with the outlet and the outlet when the turret is in the retracted position.

16. A nozzle assembly as recited in claim 10, wherein the turret defines a notch corresponding to each nozzle, and further including an alignment pin mounted to the body and selectably engageable with each notch.

17. A nozzle assembly as recited in claim 10, wherein each receptacle includes a ledge and each nozzle includes a base configured for engaging the ledge of each receptacle, and further including a disk mounted on the second end of the shaft between the body and the turret and contacting the base of each nozzle to retain each nozzle in its respective receptacle.

18. A nozzle assembly comprising:

a body including an outlet;

a shaft having a first end mounted to the body and a second end extending from the body;

means for moving the shaft between a retracted position and an extended position;

a turret rotationally mounted on the second end of the shaft; and a plurality of nozzles mounted on the turret for alignment with the outlet, wherein the aligned nozzle is sealingly mated with the outlet when the shaft is in the retracted position and is spaced from the outlet when the shaft is in the extended position.

19. A nozzle assembly as recited in claim 18, further including a means for locking the rotational position of the turret as each nozzle is aligned with the outlet.

20. A nozzle assembly as recited in claim 18, further including a disk mounted on the second end of the shaft between the body and the turret and contacting each nozzle to retain the nozzles in the turret.

21. A nozzle assembly as recited in claim 18, further including a tubular strut having a first end fixedly mounted to the body, wherein the shaft extends through the tubular strut and the turret is rotatably mounted on a second end of the tubular strut, further including a spring mounted on the tubular strut between the body and the turret, and further including a fastener attached to the second end of the shaft for retaining the turret on the tubular strut.

22. A nozzle assembly as recited in claim 18, further including a raised shoulder extending from the body around the outlet and defining a seat in which a seal is mounted for sealing between the aligned nozzle and the outlet when the turret is in the retracted position.

23. A nozzle assembly as recited in claim 18, wherein the turret defines a notch corresponding to each nozzle, and further including a means mounted to the body for locking the rotational position of the turret as each nozzle is aligned with the outlet.

24. A nozzle assembly as recited in claim 18, wherein the turret further includes a plurality of receptacles, and wherein each nozzle is removeably mounted in one of the receptacles.

25. A nozzle assembly as recited in claim 24, wherein each receptacle includes a ledge and each nozzle includes a base configured for engaging the ledge of each receptacle, and further including a disk mounted on the second end of the shaft between the body and the turret and contacting the base of each nozzle to retain each nozzle in its respective receptacle.

26. A nozzle assembly as recited in claim 18, further including a handle for actuating the means for moving the shaft.

* * * * *